US005896916A

United States Patent [19]

Baechner et al.

[11] Patent Number: 5,896,916

[45] Date of Patent: Apr. 27, 1999

[54] HEAT EXCHANGER SUITABLE FOR A REFRIGERANT EVAPORATOR

[75] Inventors: Thomas Baechner; Josef Kreutzer, both of Muehlacker; Christoph Walter, Stuttgart, all of Germany

[73] Assignee: Behr Gmbh & Co., Stuttgart, Germany

[21] Appl. No.: 08/749,397

[22] Filed: Nov. 15, 1996

[30] Foreign Application Priority Data

Nov. 18, 1995 [DE] Germany ..... 195 43 149

[51] Int. Cl.[6] ..... F28D 1/03; B21D 53/04

[52] U.S. Cl. ..... 165/78; 165/DIG. 464; 165/DIG. 465; 165/153

[58] Field of Search ..... 165/78, 153; 228/183

[56] References Cited

U.S. PATENT DOCUMENTS

| | | | |
|---|---|---|---|
| 3,451,114 | 6/1969 | Werneke | 228/183 |
| 5,086,832 | 2/1992 | Kadle et al. | 165/153 |
| 5,176,206 | 1/1993 | Nagasaka et al. | 165/153 |
| 5,184,673 | 2/1993 | Hedman et al. | 165/153 |
| 5,551,506 | 9/1996 | Nishishita | 165/76 |

FOREIGN PATENT DOCUMENTS

| | | |
|---|---|---|
| 0 597 778 | 5/1994 | European Pat. Off. . |
| 0 661 508 | 7/1995 | European Pat. Off. . |
| 1 928 146 | 11/1969 | Germany . |
| 113651 | 3/1918 | United Kingdom . |
| 1 204 004 | 9/1970 | United Kingdom . |

OTHER PUBLICATIONS

Patent Abstracts of Japan, vol. 015, No. 475 (M-1186), Dec. 3, 1991.

*Primary Examiner*—Allen Flanigan
*Attorney, Agent, or Firm*—Foley & Lardner

[57] ABSTRACT

In a heat exchanger made of stacked tubular elements, the tubular elements are formed from pressed plates bearing on one another. The plates enclose between them a cavity which is connected via corresponding orifices to the cavity of the tubular element adjacent in each case. In order to fix the stacked plates in their position and reliably prevent slipping along the tubular element plane, all the plates of the heat exchanger are provided with a congruent fixing orifice, into which a fixing rod can be inserted. A method for manufacturing the heat exchanger is also disclosed.

17 Claims, 5 Drawing Sheets

HEAT EXCHANGER SUITABLE FOR A REFRIGERANT EVAPORATOR

BACKGROUND OF THE INVENTION

The present invention relates to a heat exchanger, in particular a refrigerant evaporator, of the generic type comprising a plurality of tubular elements assembled to form a stack, wherein each tubular element comprises two pressed plates which enclose between them a cavity Each pressed plate has a pressed-out portion with an orifice therein positioned near at least one end of the tubular element, the pressed-out portion being capable of bearing on the adjacent tubular element and being connected to its cavity via the orifice. Corrugated ribs or fins are arranged between each two adjacent tubular elements.

U.S. Pat. No. 5,176,206 describes a heat exchanger which consists of a multiplicity of flat tubular elements, the tubular elements each being formed from two pressed plates. The tubular elements, with corrugated ribs being interposed, are assembled to form a stack. A side part is arranged at each of the two ends of the stack. The sheet metal plates from which the tubular elements are made have, at one end of their longitudinal extension, pressed-out portions with orifices arranged therein, the pressed-out portions being directed in each case to the adjacent tubular element, so that the tubular elements, succeeding one another in each case, bear with their pressed-out portions against one another. The orifices in the pressed-out portions form passages to the cavity of the next tubular elements in each case, so that a flow duct for the fluid flowing through the heat exchanger is formed.

In the known arrangement, the faces on which two plates forming a tubular element bear against one another in each case are of planar design. The tubular elements in each case adjacent to one another likewise bear with purely planar faces against one another, so that extreme care must be taken with the stack assembled from tubular elements and corrugated ribs, until, after soldering, a displacement of the plates relative to one another is no longer possible. However, such a method of treating a stack consisting of tubular elements cannot be implemented in practice, and therefore complicated fixing and clamping devices are necessary in order to secure the individual plates or tubular elements in their relative position in relation to the arrangement as a whole. However, clamping devices of this type are expensive and impede the production cycle, which is ultimately reflected in the production costs of the heat exchanger.

U.S. Pat. No. 5,086,832 discloses a heat exchanger which consists of stacked tubular elements, each consisting of two pressed plates. In this case, the plates have spacing and interlocking deformations at one end, so that the plates in each case adjacent to one another are fixed at this end to the plate adjacent to them. However, this necessitates corresponding shaping which results in an increased use of material, in an impediment to the production process and in a greater weight of the heat exchanger. Such complicated measures are also ultimately reflected in the price of the heat exchanger.

SUMMARY OF THE INVENTION

Therefore, one object of the present invention is to provide an improved heat exchanger of the generic type described above.

It is a particular object of the invention to provide a heat exchanger in which, despite a simple tubular element configuration, the production quality is improved.

A further object of the invention resides in providing an improved method of producing a heat exchanger of the above-described type.

In accomplishing the foregoing and other objects, there has been provided in accordance with one aspect of the present invention a heat exchanger suitable for use as a refrigerant evaporator, comprising a plurality of tubular elements assembled to form a stack, wherein each tubular element comprises two pressed plates which enclose between them a cavity, each pressed plate having a pressed-out portion with an orifice therein positioned near at least one end of the tubular element, the pressed-out portion being capable of bearing on the adjacent tubular element and being connected to its cavity via the orifice, and corrugated ribs arranged between each two adjacent tubular elements, wherein each pressed plate of the heat exchanger includes a congruent fixing orifice for receiving a fixing rod inserted into the fixing orifices of the stacked tubular elements of the heat exchanger.

In accordance with another aspect of the present invention, there has been provided a method of manufacturing a heat exchanger suitable for use as a refrigerant evaporator, comprising: assembling a plurality of tubular elements to form a stack, wherein each disk comprises two pressed plates which enclose between them a cavity, each pressed plate having a pressed-out portion with an orifice therein positioned near at least one end of the tubular element, the pressed-out portion being capable of bearing on the adjacent tubular element and being connected to its cavity via the orifice, and wherein each pressed plate includes a congruent fixing orifice for receiving a fixing rod to be inserted into the fixing orifices of the stacked tubular elements; arranging corrugated ribs between each two adjacent tubular elements; and inserting a fixing rod into the fixing orifices of the stacked tubular elements in order to hold the tubular elements in alignment during at least a part of the manufacturing method.

The essential advantages of the invention include the fact that the heat exchanger can be produced more simply and therefore more cost-effectively, along with enhanced production quality, because no complicated fixing means have to be shaped on the plates forming the tubular elements, and there is also no need for any clamping devices for fixing the tubular element stack in position.

Further objects, features and advantages of the present invention will become apparent to those skilled in the art from the detailed description of preferred embodiments that follows, when considered together with the accompanying figures of drawing.

BRIEF DESCRIPTION OF THE DRAWINGS

An exemplary embodiment of the heat exchanger according to the invention is explained in more detail below with reference to the drawings wherein.

DETAILED DESCRIPTION OF PREFERRED EMBODIMENTS

Figure 1:
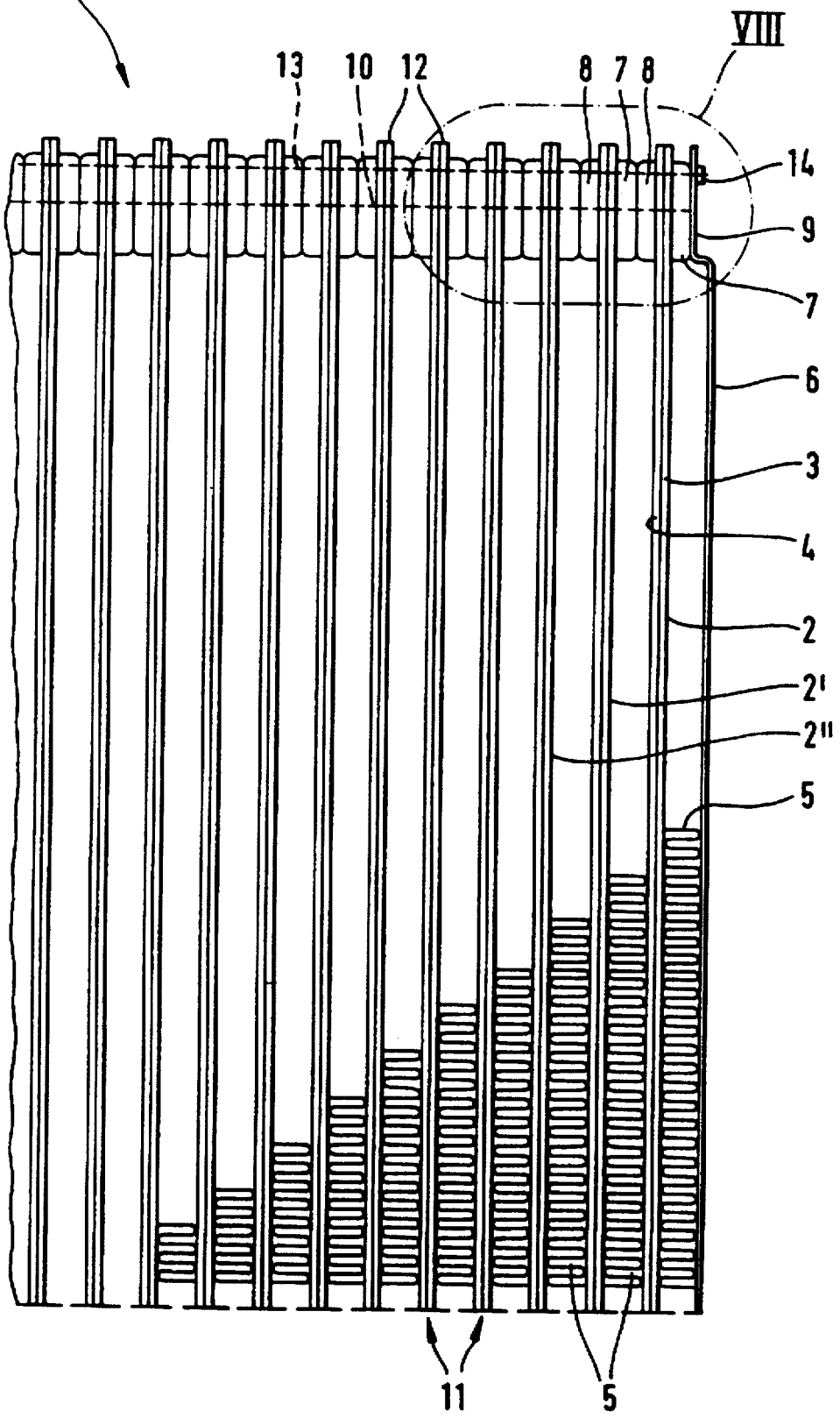
FIG. 1 is a side view of a heat exchanger according to the invention formed from tubular elements.

According to one advantageous embodiment of the invention, the orifices are arranged outside the pressed-out portions, but in their vicinity. In this way, the fixing means are located outside the fluid-carrying heat exchange ducts, that is to say no additional soldering joints are provided in the region of the ducts. Moreover, the advantage of arranging the fixing means near the pressed-out portions is that these pressed-out portions and also the orifices present in them for connecting the cavities of the tubular elements in each case adjacent to one another are reliably located congruently one above the other, and therefore the entire soldering surface which surrounds the orifices is available. So that a standard type of pressed plate can be used when the stack of plates is being formed in order to produce the heat exchanger consisting of tubular elements, it is advantageous if the fixing orifices lie in an axis of symmetry running in the longitudinal direction of the tubular elements.

Conventionally, the first and the last tubular element of a heat exchanger consisting of a tubular element stack are also provided with corrugated ribs on both sides, wherein these (in each case) outer corrugated ribs are covered by a side part or end piece. So that the fixing of the entire stack of tubular elements also includes these side parts, it is advantageous if fixing orifices, which are congruent with the fixing orifices of the tubular elements, are likewise provided in the side parts. The fixing orifices of the plates forming the tubular elements and of the side parts preferably have a circular cross section, as does the fixing rod.

Since the fixing rod does not result in an appreciable increase in the weight of the heat exchanger, it is expedient (although not necessary) to leave it in the heat exchanger and, during the soldering process, connect the fixing rod integrally to the tubular elements and the side parts. In this case, it is considered to be particularly advantageous if the fixing orifices are surrounded by rims shaped from the material of the plates, so that a sufficient soldering surface is available between the fixing rod and the plates. Such soldering between the plates and the fixing rod leads to an increase in the strength of the heat exchanger and, in particular, to an increase in the bursting pressure Since the plates are stacked in pairs to form a tubular element, these being joined to one another mirror-symmetrically, the rims of two plates which form a tubular element point in opposite directions. In order to avoid a separate application of solder, the plates consist of solder-plated aluminum, so that the bearing faces between the rims and the fixing rod consisting of aluminum wire provide a sufficient supply of solder. The thickness of the fixing rod can be dimensioned according to the design of the heat exchanger, and it is considered advantageous if the fixing rod and, correspondingly, also the fixing orifices receiving it have a diameter of approximately 2 mm to 5 mm, preferably 3 mm.

Referring now to the drawings, FIG. I shows a heat exchanger 1 which consists of a multiplicity of parallel tubular elements 2, 2', 2". These tubular elements 2, 2', 2" are stacked, and a corrugated rib 5 is arranged in each case between two successive tubular elements 2, 2', 2". A side part or end piece 6 runs parallel to the outermost tubular element 2, the distance between the side part 6 and the outermost tubular element 2 being equal to the distance between two adjacent tubular elements 2, 2', 2", so that a corrugated rib 5 can also be arranged between the side part 6 and the outermost tubular element 2. Each of the tubular elements 2, 2', 2" is formed from two pressed plates 3 and 4 which, by virtue of their shaping, enclose between them cavities which serve for carrying a heat exchanger fluid, preferably a refrigerant of an air-conditioning system. The plates 3 and 4 are designed identically and are placed mirror-symmetrically against one another, so that they have the same configuration on the two flat sides.

The tubular elements 2 have, at lower ends 11, only a bent plate edge, but no additional pressed-out portions, so that the fluid ducts formed in the cavities of the tubular elements are deflected in the lower tubular element region. At their upper ends 12, the plates 3 and 4, which in each case form a tubular element 2, have pressed-out portions 7 and 8 pointing in opposite directions. In each case, a pressed-out portion 7 of a tubular element 2 comes into mutual bearing contact with a pressed-out portion 8 of the subsequent tubular element 2' or 2". Orifices are provided in these pressed-out portions 7 and 8, and all of the orifices of the stacked tubular elements 2 are congruent and make a connection between the cavity of the respective tubular element 2 and the cavity of the adjacent disk 2' or 2". In this way, one or more collecting spaces are provided by the multiplicity of pressed-out portions 7 and 8 of the stacked tubular elements 2, wherein the axis of the collecting space is designated by 10 in the exemplary embodiment of FIG. 1.

In the upper ends 12 of the tubular elements 2, 2', 2", a fixing rod 13 runs through the entire heat exchanger 1 orthogonally relative to the tubular element plane, one end 14 of the fixing rod 13 projecting onto the outside through a bent portion 9 of the side part 6. The bent portion 9 of the side part 6 bears on the pressed-out portion 7 of the plate 3 of the tubular element 2 and is soldered sealingly to said pressed-out portion, in order to close off relative to the outside the collecting space which is formed in the upper end 12 of the tubular elements 2, 2', 2".

Figure 2:
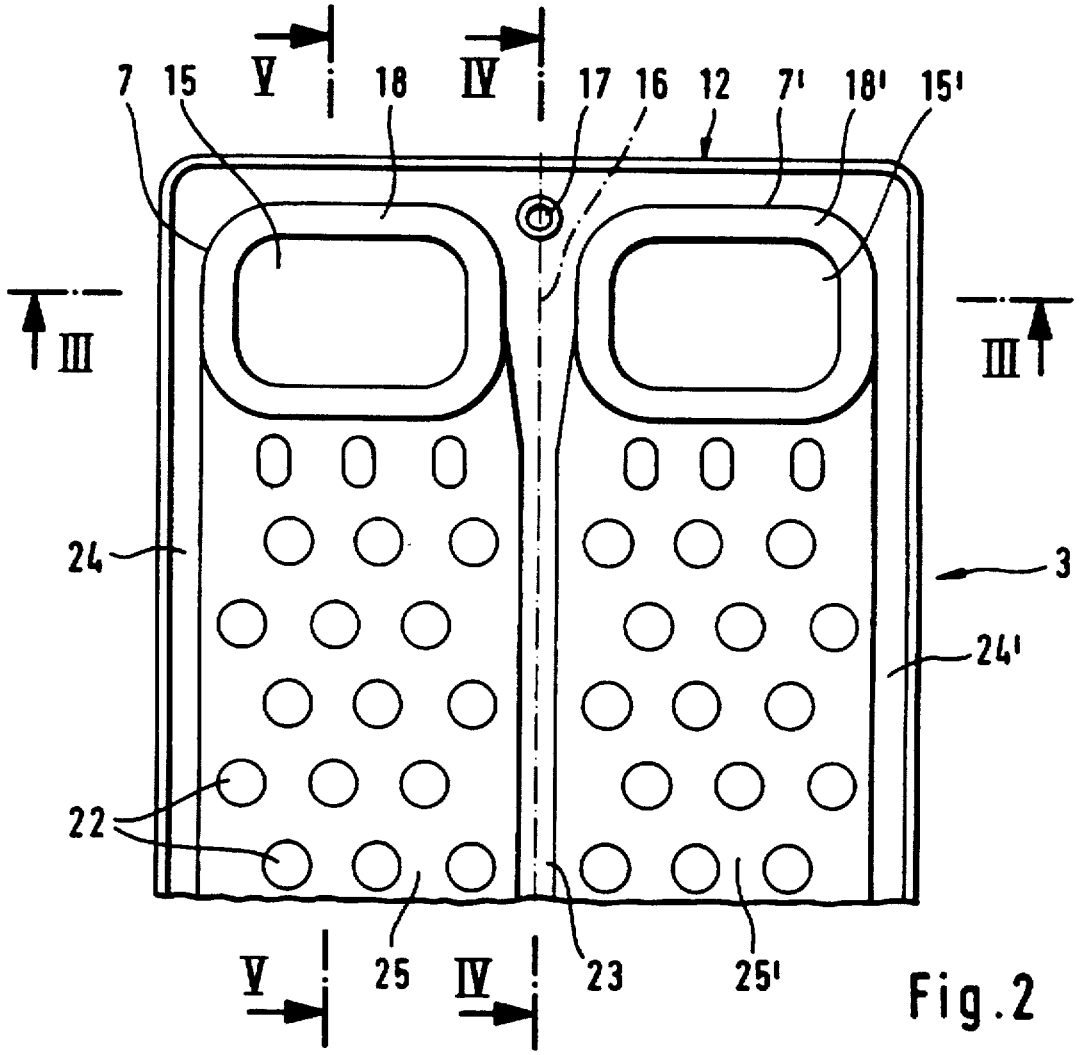
FIG. 2 is a plan view showing the detail of a pressed plate for forming the tubular elements.

FIG. 2 shows the upper portion with the end 12 of the pressed plate 3 in an enlarged representation. This plate 3 is designed in such a way that there are arrangements of pressed-out portions which are mirror-symmetrical relative to an axis of symmetry 16 which runs in the longitudinal direction of the plate 3. Located between a middle web 23 and outer edges 24, 24" are shallow depressions 25, 25", by means of which the cavities for the fluid-carrying ducts are formed when two plates 3, 4 are joined together, with the planar edges 24, 24" and web 23 of said plates bearing on one another. Arranged in these shallow depressions 25, 25" are a multiplicity of nipple-shaped elevations 22 which come into bearing contact with nipple-shaped elevations of the other plate of the same tubular element and which are connected integrally to these. In this way, not only is the flow within the cavities formed by the shallow depressions 25, 25' influenced, but ties or reinforcing connections are also formed. These ties prevent the tubular elements from swelling as a result of the fluid pressure prevailing within the cavities.

Two pressed-out portions 7, 7' are formed near the upper end 12 of the plate 3, and in these are located stamped-out orifices 15 which are surrounded by a bearing face 18, 18' running parallel to the tubular element plane. These bearing faces 18, 18' serve for bearing on corresponding faces of the adjacent tubular element and at the same time form a soldering surface which sealingly closes, relative to the outside, the cavities formed within the tubular elements or the collecting tubes formed by the orifices 15 of all the tubular elements. A fixing orifice 17, which serves for receiving the fixing rod shown in FIG. 1, is located at the upper end 12 in the axis of symmetry 16 of the plate 3. This fixing orifice 17 is located outside the pressed-out portions 7, 7' and therefore also outside the fluid-carrying cavities or the collecting tubes formed by the orifices 15, 15'.

Figure 3:
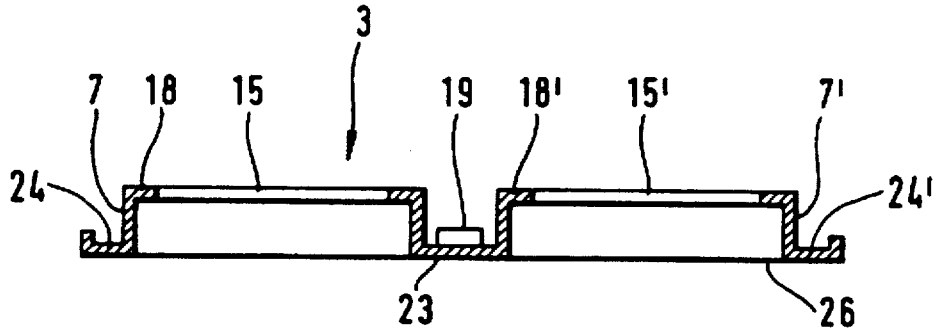
FIG. 3 is a sectional view taken along the line III—III in FIG. 2.

FIG. 3 shows a section along the line III—III in is FIG. 2. It is evident from this representation that the lateral edges 24, 24' and the middle web 23 run in one plane and thereby serve as a bearing face 26 for a further plate which, together with the plate 3, forms a tubular element. The pressed-out portions 7 and 7', from which orifices 15, 15' are stamped out, are arranged between the middle web 23 and the lateral edges 24, 24'. These orifices 15, 15' are each surrounded by a bearing face 18, 18' which runs parallel to the tubular element plane 26 and which, when bearing on the next tubular element, serves as a soldering surface. Provided between the pressed-out portions 7, 7" is a rim 19 which surrounds the fixing orifice shown in FIG. 2 and which projects from the plate plane 26 in the same direction as the pressed-out portions 7 and 7'.

Figure 4:
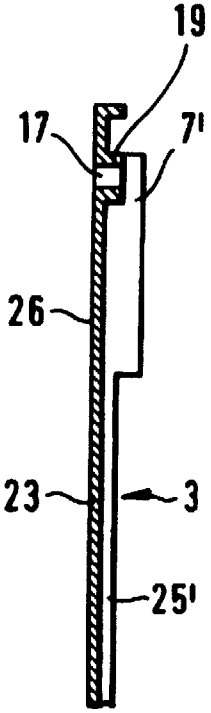
FIG. 4 is a sectional view taken along the line IV—IV in FIG. 2.

FIG. 4 shows a section along the line IV—IV in FIG. 2. In this case, the section passes through the fixing orifice 17 which is located in the axis of symmetry and which is surrounded by the rim 19. The pressed-out portion 7' is elevated from the plate plane 26 to a appreciably greater extent, and the pressed-out portion 7' has adjoining it a shallow depression 25 which forms the fluid duct within the tubular element.

Figure 5:
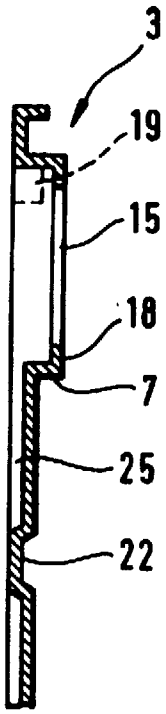
FIG. 5 is a sectional view taken along the line V—V in FIG. 2.

FIG. 5 shows a section along the line V—V in FIG. 2, that is to say, the section passes through the pressed-out portion 7 of the plate 3. It is evident from this representation that the shallow depression 25 runs into and communicates with the pressed-out portion 7, and a cavity connected to the collecting tube is thereby formed within a tubular element by two plates which form the tubular element. The rim 19, concealed in FIG. 5, is represented by broken lines.

Figure 7:
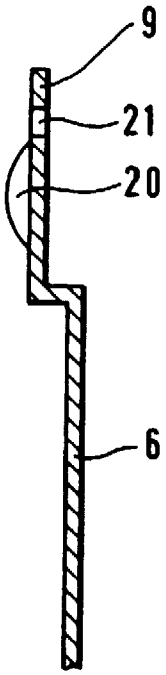
FIG. 7 is a sectional view taken along the line VII—VII in FIG. 6.
Figure 6:
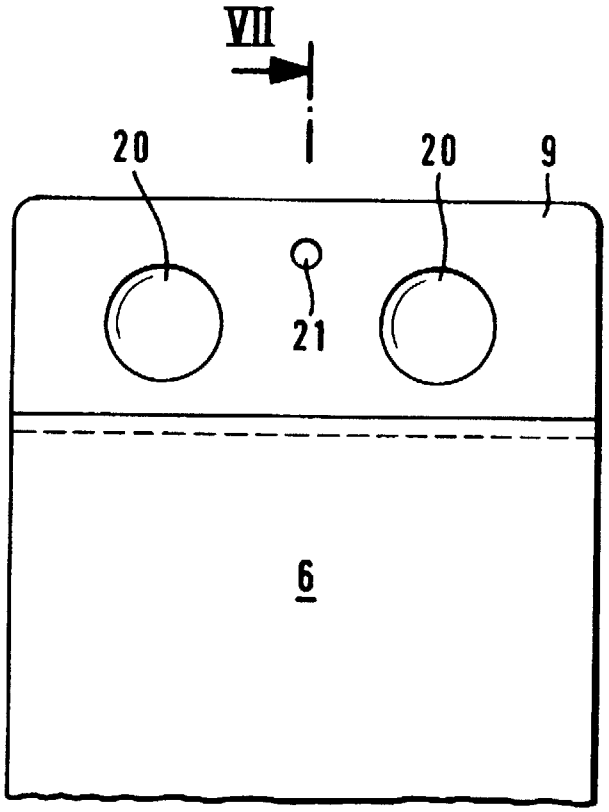
FIG. 6 is a plan view showing a detail of a side part.

FIG. 6 shows a detail of the side part 6 with the bent portion 9. FIG. 7 is a sectional view taken along the line VII—VII in FIG. 6. As becomes clear from the section in FIG. 7, two domes 20 are provided in the bent portion 9, and these domes extend out of the plane of the side part 6 in the direction which faces the adjacent tubular element of the heat exchanger. This is intended to ensure that, in the heat exchanger consisting of stacked tubular elements, the domes 20 project into the orifices 15, 15 of the outer tubular element. Located in the bent portion 9 of the side part 6, according to the representation in FIGS. 6 and 7, is a fixing orifice 21 which has at least approximately the same cross section as the fixing orifice in the plates which form the tubular element. By virtue of the material thickness of the side part 6, a sufficient surface for soldering to a fixing rod is provided within the fixing orifice 21, so that a rim, such as is present in the case of the plates forming the tubular elements, can be dispensed with.

Figure 8:
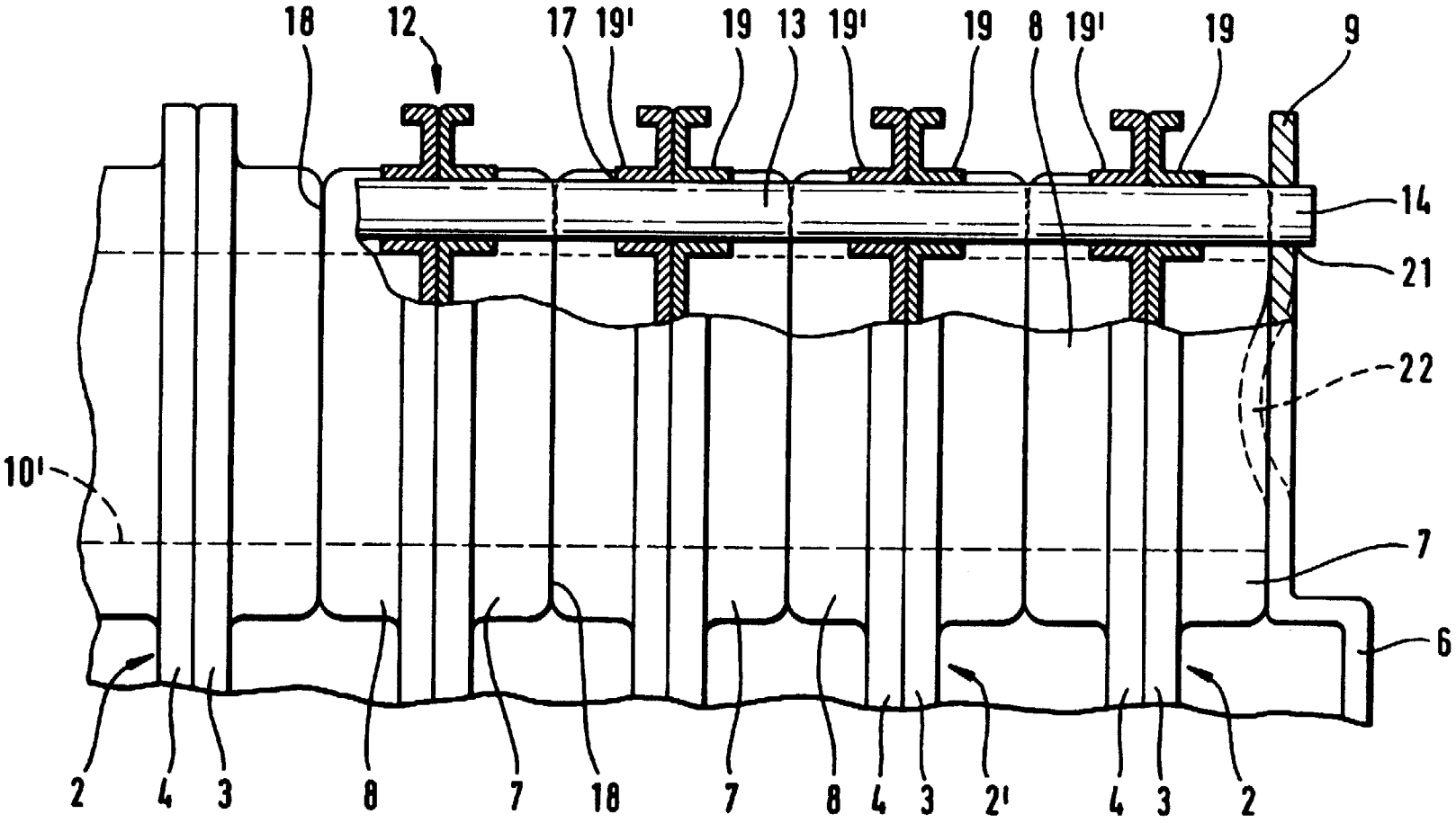
FIG. 8 is an enlarged representation of the detail VIII in FIG. 1, partially in section.

FIG. 8 shows an enlarged representation of the detail VIII from FIG. 1. In this case, the region adjacent to the end 12 of the tubular elements 2 is cut away, so that the arrangement of the fixing rod 13 within the plates 3 and 4 forming the tubular elements 2 can be seen. The pressed-out portions 7 and 8 of the tubular elements 2, 2', 2" form a collecting tube 10' represented by broken lines. Depending on the arrangement of the inflow and return connections for the heat exchanger fluid, an orifice as well as a connection piece can be provided on the end face, that is to say, on the bent portion 9 of the side part 6, instead of the dome 20.

The rims 19, 19', which each point in an opposite direction and which surround the fixing orifices 17, are located in the plates 3 and 4 of the tubular elements 2, 2', 2" in a plane which lies outside the collecting tube 10'. The fixing orifices 17 and therefore also the rims 19, 19' of all the plates 3, 4 are oriented in such a way that they are located congruently one above the other, as is the fixing orifice 21 in the bent portion 9 of the side part 6. A fixing rod 13 extends through all the tubular elements 2 of the stacked plates 3, 4 and the side part 6, the cross section of said fixing rod being matched to the cross section of the fixing orifices 17 and 21. This results in a bearing face between the rims 19, 19' or the bent portion 9 and the fixing rod 13, so that, when the heat exchanger is being soldered, an integral connection of all the plates 3, 4 and the side part 6 to the fixing rod 13 is made. The fixing rod 13 corresponds in length to the stack of tubular elements 2, merely one end 14 of the fixing rod 13 projecting slightly from the bent portion 9 of the side part 6.

Both the plates 3, 4 and the side part 6 preferably consist of solder-plated aluminum. The provision of solder plating on one side is normally sufficient for the side part 6. In contrast, the plates 3, 4 are solder-plated on both sides, since they possess, on the mutual bearing faces for forming a tubular element and also on the bearing faces relative to the next tubular element in each case, soldering surfaces, on which a corresponding supply of solder must be provided. The fixing rod 13 expediently consists of an aluminum wire which is soldered to the plates 3, 4 by means of the solder plating present within the rims 19, 19'. As a result of the soldering, the fixing rod not only has the effect of aligning all the plates exactly in position, but, in addition, leads to an increase in the strength of the tubular elements 2, 2', 2" in this region located between the collecting tubes 10'. The cross section of the fixing orifices and of the fixing rod can be dimensioned in conformity with the strength requirements, with a diameter of approximately 2 mm to 5 mm generally being satisfactory. A cross section with a diameter of 3 mm is considered as a particularly preferred design.

Figure 9:
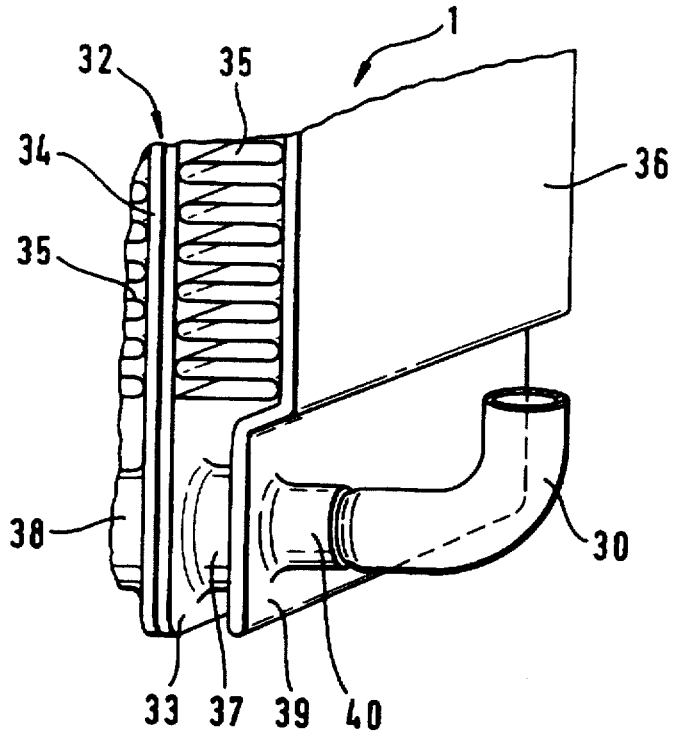
FIG. 9 is a perspective view showing a detail of the end region of a heat exchanger with a connecting pipe.

FIG. 9 shows a perspective representation of a detail of the heat exchanger, to which a connecting pipe is fastened by soldering. This soldering is preferably carried out simultaneously with the soldering of the heat exchanger, that is to say, it involves so-called mass or bulk soldering The heat exchanger 1 consists of tubular elements 32, which are formed from plates 33 and 34 joined to one another, and from corrugated ribs or fins 35 arranged between the latter. The lateral end of the heat exchanger forms a side part 36 comprising a bent portion 39, in which an orifice is formed having a rim 40 surrounding the latter and directed orthogonally relative to the plane of the side part. The rim 40 points away from the adjacent tubular element 32. The end of a connecting pipe 30 is soldered in the rim 40. The plates 33 and 34 are provided with pressed-out portions 37 and 38, the design of the heat exchanger therefore corresponding essentially to the representation in FIG. 1 already described. A fixing rod is also used in the embodiment of FIG. 9, but it cannot be seen in this representation.

Figure 10:
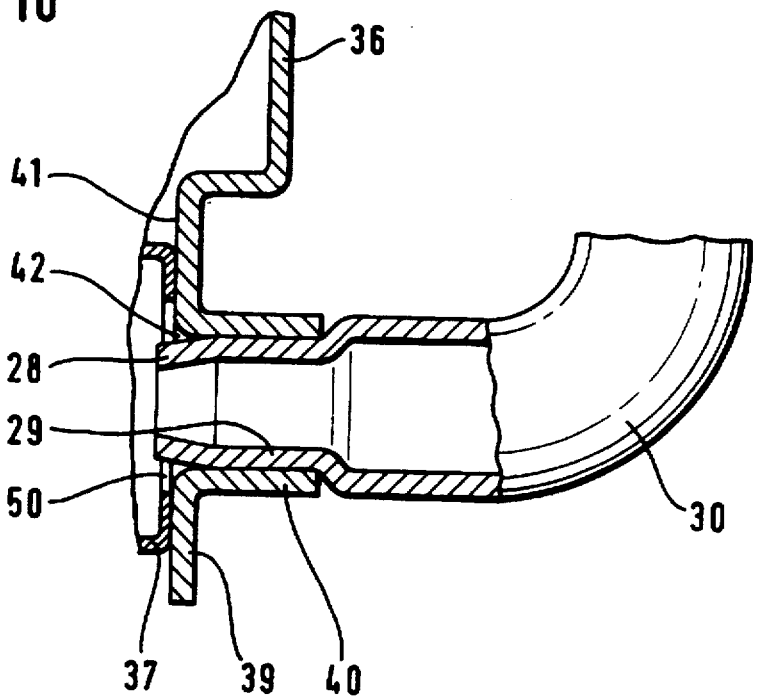
FIG. 10 is a sectional view taken through a side part and a connecting pipe.

FIG. 10 shows, in an enlarged representation, a section through the side part 36 and through the connecting pipe 30 fastened to the latter. The side part 36 comprises the bent portion 39 which serves for bearing on the pressed-out portion 37 of the plate 33, where pressed-out portion is shown in FIG. 9. Provided in the bent portion 39 is an orifice 42 which is surrounded by the rim 40. This orifice 42 overlaps with the orifice 50 in the pressed-out portion 37. The side part 36 is provided with solder plating on the side 41 facing the heat exchanger block, so that the rim 40 shaped from the bent portion 39 also has, on its inner face, a sufficient supply of solder for soldering to a contracted portion 29 of the connecting pipe 30. The contracted portion 29 can be produced, for example, by rolling and has, at its front end, a cone 28 which serves as an introduction aid when the connecting pipe is being inserted into the rim 40.

Although the invention has been described and explained with reference to only a limited number of preferred embodiments, those skilled in the art will realize that various changes, substitutions and/or modifications are possible within the basic concept of the present invention It is intended that all embodiments of the invention resulting from such changes, substitutions and/or modifications shall be covered by the appended claims.

What is claimed is:

1. A heat exchanger suitable for use as a refrigerant evaporator, comprising a plurality of tubular elements assembled to form a stack, wherein each tubular element comprises two pressed plates which enclose between them a cavity, each pressed plate having a pressed-out portion with an orifice therein positioned near at least one end of the tubular element, the pressed-out portion being capable of bearing on the adjacent tubular element and being connected to its cavity via the orifice, and corrugated ribs arranged between each two adjacent tubular elements, wherein each pressed plate of the heat exchanger includes a congruent fixing orifice for receiving a fixing rod to be inserted into the fixing orifices of the stacked tubular elements of the heat exchanger, and wherein the fixing orifices are arranged outside the pressed-out portions, but in the vicinity of the pressed-out portions.

2. A heat exchanger as claimed in claim 1, wherein the fixing orifices are located in an axis of symmetry running in the longitudinal direction of the plates forming the tubular elements.

3. A heat exchanger as claimed in claim 1, further comprising at each end of the stack of tubular elements a side part, having a fixing orifice congruent with the fixing orifices of the tubular elements.

4. A heat exchanger as claimed in claim 3, wherein the fixing orifices have a circular cross section.

5. A heat exchanger as claimed in claim 4, further comprising a fixing rod inserted in the fixing orifices, and wherein the fixing rod is soldered to the tubular elements.

6. A heat exchanger as claimed in claim 4, wherein the fixing orifices are surrounded by rims shaped from the material of the plates.

7. A heat exchanger as claimed in claim 6, wherein the fixing orifice rims of two plates which form a tubular element point in opposite directions.

8. A heat exchanger as claimed in claim 5, wherein the plates comprise solder-plated aluminum, and the fixing rod comprises an aluminum wire.

9. A heat exchanger as claimed in claim 5, wherein the fixing orifices and the fixing rod have a diameter of approximately 2 mm to 5 mm.

10. A heat exchanger as claimed in claim 9, wherein the diameter is 3 mm.

11. A heat exchanger as claimed in claim 3, wherein the side part comprises a material solder-plated on one side, wherein the solder-plated side faces the adjacent tubular element.

12. A heat exchanger as claimed in claim 3, wherein the side part includes an orifice which is surrounded by a rim and which is in alignment with the orifice in the pressed-out portion.

13. A heat exchanger as claimed in claim 12, further comprising a connecting pipe connected to the side part orifice rim.

14. A heat exchanger as claimed in claim 13, wherein the connecting pipe has a contracted portion which is located in the rim of the side part.

15. A method for manufacturing a heat exchanger suitable for use as a refrigerant evaporator, comprising:

assembling a plurality of tubular elements to form a stack, wherein each tubular element comprises two pressed plates which enclose between them a cavity, each pressed plate having a pressed-out portion with an orifice therein positioned near at least one end of the tubular element, the pressed-out portion being capable of bearing on the adjacent tubular element and being connected to its cavity via the orifice, wherein each pressed plate includes a congruent fixing orifice for receiving a fixing rod to be inserted into the fixing orifices of the stacked tubular elements, and wherein the fixing orifices are arranged outside the pressed-out portions, but in the vicinity of the pressed-out portions;

arranging corrugated ribs between each two adjacent tubular elements; and inserting a fixing rod into the fixing orifices of the stacked tubular elements in order to hold the tubular elements in alignment during at least a part of the manufacturing method.

16. A method as claimed in claim 15, further comprising the step of soldering the stacked tubular elements together after insertion of said fixing rod into the fixing orifices.

17. A method as claimed in claim 16, wherein the fixing rod is also soldered to the stacked tubular elements during said soldering step.

* * * * *